United States Patent [19]

Vin Dick et al.

[11] 4,331,720

[45] May 25, 1982

[54] CHRISTMAS TREE

[76] Inventors: James Vin Dick, c/o George Spector, 3615 Woolworth Bldg., 233 Broadway; George Spector, 3615 Woolworth Bldg., 233 Broadway, both of New York, N.Y. 10007

[21] Appl. No.: 154,903

[22] Filed: May 30, 1980

[51] Int. Cl.[3] ..... A47G 33/06

[52] U.S. Cl. ..... 428/9; 428/20; 428/35

[58] Field of Search ..... 428/9, 18, 19, 20, 35; 362/123

[56] References Cited

U.S. PATENT DOCUMENTS

| | | | |
|---|---|---|---|
| 1,600,687 | 9/1926 | Mantz | 428/18 X |
| 3,176,123 | 3/1965 | Blake | 428/12 X |
| 3,677,867 | 7/1972 | Westlund | 428/20 X |
| 3,967,019 | 6/1976 | Magee | 428/18 X |
| 4,130,678 | 12/1978 | Higgins | 428/20 X |
| 4,130,678 | 12/1978 | Higgins | 428/9 |

FOREIGN PATENT DOCUMENTS

| | | | |
|---|---|---|---|
| 488501 | 12/1952 | Canada | D11/118 |

OTHER PUBLICATIONS

The "Spiral Tree", shown on p. 16 of the Dec. 15, 1940 issue of Vogue.

*Primary Examiner*—Henry F. Epstein

[57] ABSTRACT

A collapsible, artificial Christmas tree which folds away into a relatively thin box which serves as a stand for the tree when erected, the tree including a generally spiral coil of steel wire which is axially stretched between opposite ends of an assembled pole so to form a conical structure resembling a tree, the wire being coated with artificial pine covering and carrying Christmas tree electric lamps.

1 Claim, 7 Drawing Figures

10
4
16
17
19
4
17

11a 11
13
3
12
3

11a 13
11

15

26
24
23
25
14

19
20
19
20
16
17
18
21
22
18

CHRISTMAS TREE

This invention relates generally to artifical Christmas trees. A principal object of the present invention is to provide a simulated Christmas tree of collapsible type which is quick and easy to be erected or folded up into a thin box for convenient carrying or storage.

Another object is to provide a simulated Christmas tree which is modernistic in design, is fireproof, conserves on the cutting down of live trees for use as Christmas trees, and which will last for many years.

Figure 1:
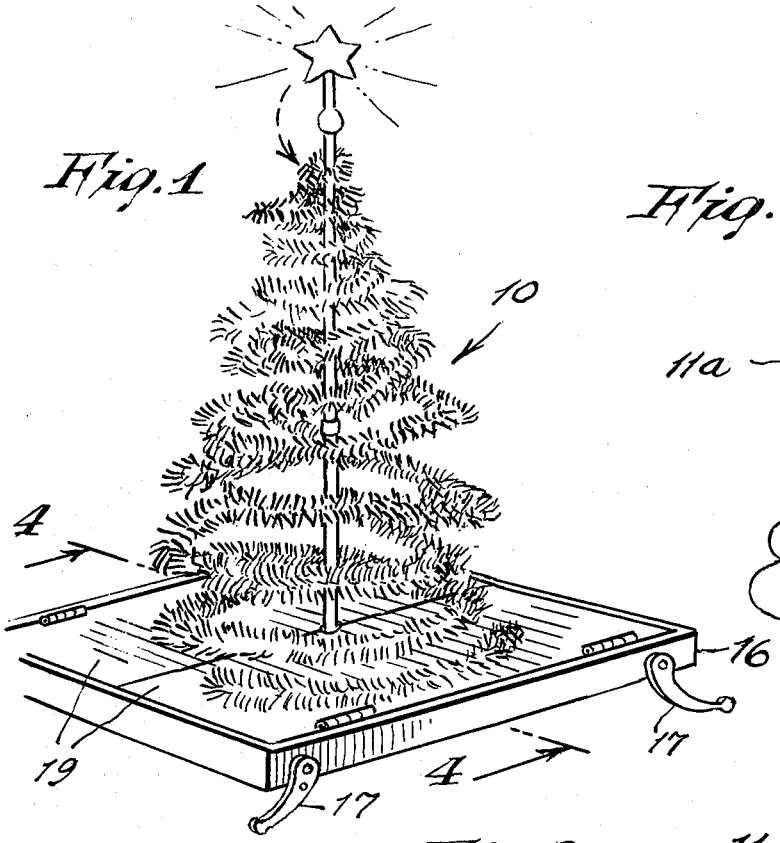
FIG. 1 is a perspective view of the invention, and wherein the tree is made to appear realistic by having a wire spiral that forms the tree branches, to be irregularly bent, as shown in FIG. 2, instead being circularly bent, as shown in FIG. 7.

Referring now to the drawings in greater detail, and more particularly to FIGS. 1 through 5 thereof at this time, the reference numeral 10 represents a Five Minutes Up and Five Minutes down Christmas tree according to the present invention, wherein there is a generally spiral shaped coil of stiff wire 11, wherein each spiral turn 12 thereof is irregularly bent as shown at 13 so that when the coil is axially stretched into a conical shape, the irregular bends give a more realistic appearance of the branches of a Christmas Tree.

The wire is covered with conventional artificial pine covering 14 and additionally carries an electric lamp system 15 such as is conventional on ordinary Christmas Trees. Current may be supplied to the lamps and wire of FIG. 5 via an electric cord and plug of FIG. 1 connected to a household outlet as is conventional.

Figure 2:
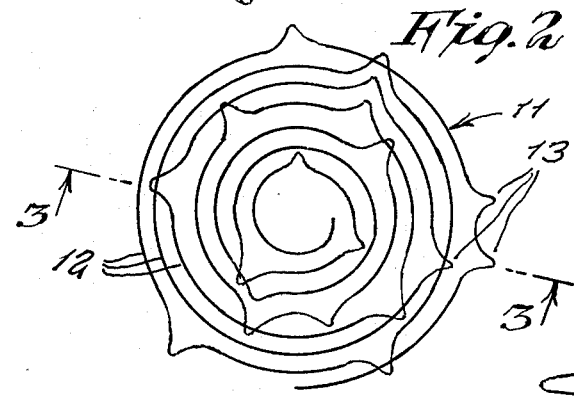
FIG. 2 is a top view of the wire spiral which can be collapsed flat so to fit inside the base box for storage when not used, and which when wished to be erected, is simply pulled upward by its central turn, so that the irregular bends of each turn do not get hooked up in adjacent turns.

As shown in FIG. 2 the irregular bends at 13 are additionally axially bent so that they do not get tangled in adjacent turns 12 of the wire coil when in a collapsed position.

A flat box 16 serves as a case for containing the tree when in a collapsed position, and serves as a stand for the tree when in an erected position. The box includes arcuate legs 17 for raising the box above a floor when used as a stand, the legs each having a slidable peg 18 for locking against the box underside when in a utility position.

Upwardly pivotable covers 19 swing on hinges 20 for providing access to a storage space 21 inside the box. A block 22 inside the space 21 serves to hold up a post 23 inserted in the block. The post is made of interfitted sections 24 and 25. An upper end of the post has a cross hole 26 in which the end of the spiral coil of wire is inserted for holding the wire in axially stretched position resembling a Christmas tree. The post extends upward between the mating edges of the covers 19.

When in a stored away condition, the disassembled post fits inside the box space 21 together with the collapsed spiral tree.

Figure 6:
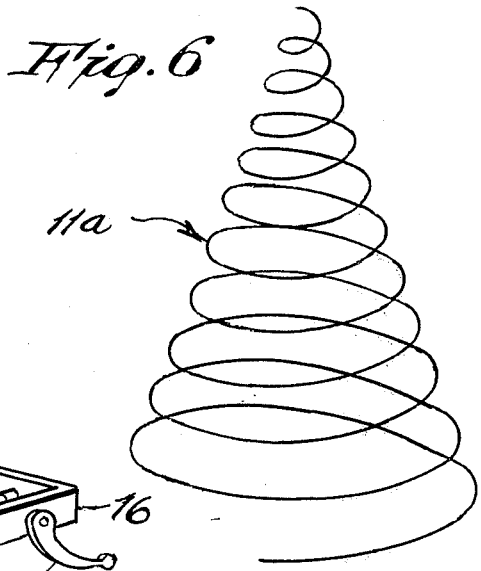
FIG. 6 is a perspective view of another design of the wire spiral.
Figure 7:
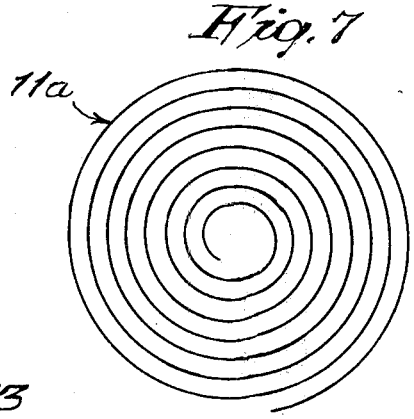
FIG. 7 is a top view thereof.
Figure 3:
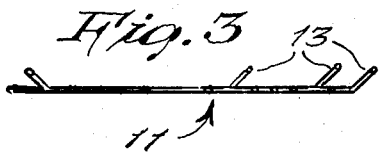
FIG. 3 is a cross sectional view on line 3—3 of FIG. 2, and showing the irregular bends additionally being angularly upward (or even straight vertically upward) so to improve realism of a tree shape, and further prevent hooking up turns.
Figure 5:
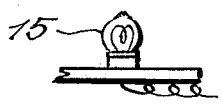
FIG. 5 is an enlarged side view of one of the solid state wiring of one of the lamps on the tree.
Figure 4:
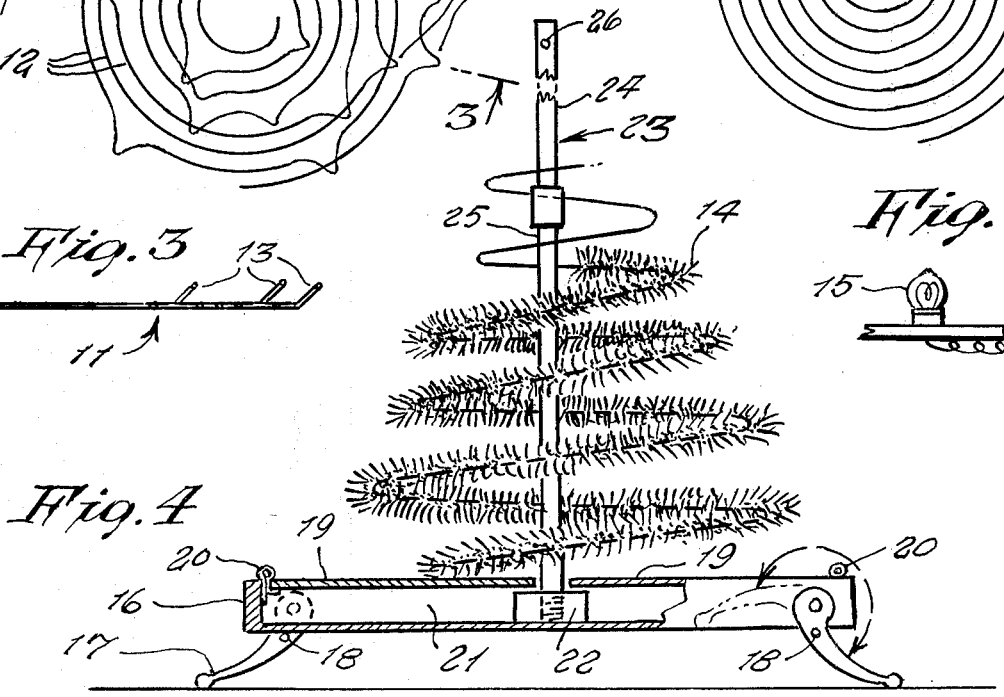
FIG. 4 is a cross sectional view on line 4—4 of FIG. 1 shown fragmentarily.

In FIGS. 6 and 7, another design of spiral coiled wire 11*a* is shown that differs from wire 11 by not including any irregular bends such as shown at 13, so that the tree thus is more modernistic in appearance rather than realistic.

While various changes may be made in the detail construction, it is understood that such changes will be within the spirit and scope of the present invention as is defined by the appended claims.

What is claimed:

1. A collapsible artificial Christmas tree comprising a base having a collapsible center rod mounted removably thereon in combination with a spiral coil encompassing said rod and secured to the rod through a hole in the rod at an upper end of said rod including artificial pine covering mounted on said coil in combination with means for storing said tree in collapsed condition, comprising a side wall means secured to said base periphery, a cover pivotally secured to said side wall, said rod being extendable through a central hole in said cover said means further including adjustable legs secured to said side wall, said coil including spaced irregular portions to provide a realistic contour.

* * * * *